United States Patent [19]

Curran

[11] 4,173,964

[45] Nov. 13, 1979

[54] SAFETY FOR THE TRIGGER MECHANISM OF A GUN

[75] Inventor: Roger Curran, Stratford, Conn.

[73] Assignee: Bangor Punta Operations, Inc., Greenwich, Conn.

[21] Appl. No.: 765,553

[22] Filed: Feb. 4, 1977

[51] Int. Cl.[2] ..... F41C 17/00; F41B 11/06

[52] U.S. Cl. ..... 124/40; 42/70 E; 124/74

[58] Field of Search ..... 124/31, 37, 40, 66, 124/67, 68, 69, 70, 73, 74, 75, 76, 77; 42/69 R, 70 R, 70 C, 70 D, 70 E; 89/144, 148, 150

[56] References Cited

U.S. PATENT DOCUMENTS

| | | | |
|---|---|---|---|
| 841,807 | 1/1907 | McGillivray | 42/69 R |
| 1,807,727 | 6/1931 | Brinkerhoff | 89/150 X |
| 3,464,399 | 9/1969 | Fisher | 124/40 X |
| 3,908,626 | 9/1975 | Hammond | 124/67 |
| 4,067,309 | 1/1978 | Wohrstein | 124/67 |

FOREIGN PATENT DOCUMENTS

| | | | |
|---|---|---|---|
| 2210103 | 9/1973 | Fed. Rep. of Germany | 42/69 R |

*Primary Examiner*—Richard T. Stouffer
*Attorney, Agent, or Firm*—Patrick J. Walsh

[57] ABSTRACT

Disclosed is a safety for the trigger mechanism of a gas powered gun including a safety lever, and a safety latch. The gun has a trigger mechanism including a trigger pivotably carrying a sear on a sear pivot pin, and a hammer engageable by the sear for opening a valve and releasing gas under pressure to propel a projectile from the gun barrel. The safety lever, safety latch, trigger and sear pivot pin have cooperating cam surfaces which return the safety latch to a safe position upon partial movement from its safe position toward a fire position; return the safety latch to its safe position upon partial squeezing and release of the trigger; return the safety latch and the safety lever to the safe position upon each firing of the gun whereby repeat firing is prevented; prevent repeat firing of the gun in the event the safety lever is continuously biased toward the fire position; and prevent firing of the gun when the safety lever is rigidly maintained in its fire position.

27 Claims, 9 Drawing Figures

SAFETY FOR THE TRIGGER MECHANISM OF A GUN

The present invention relates to guns and more particularly, relates to a safety for the trigger mechanism of a gas powered gun.

Safe use of a gun, for example a gas powered BB gun, is of paramount importance. Frequently, however, such guns are tampered with or handled carelessly with consequent potential or actual serious injury to the individual using the gun or others within the range of the gun. For example, many guns are provided with a safety which is freely movable between safe and fire positions without any automatic return to the safe position after firing. When the safety on such guns is moved to the fire position, it is frequently left in that position after shooting is discontinued, thus defeating the purpose of the safety in the future handling of the gun and creating a potential for serious injury. Also, not infrequently the trigger is only partially pulled and then released leaving the safety in its fire position. Often, the individual forgets that the safety is in its fire position and may even pass the gun to another individual who is not aware that the safety is in the fire position. Further, individuals sometimes tamper with the gun in efforts to maintain the safety in its fire position or to completely bypass the safety during use of the gun. Obviously, the potential for serious injury under these and other conditions remains.

The present invention provides a safety for the trigger mechanism of a gun which minimizes or eliminates the foregoing and other problems associated with prior safeties for guns and provides a novel and improved safety for the trigger mechanism of a gas fired gun having various advantages in construction, operation and use in comparison with such prior safeties. Particularly, there is provided a safety which automatically returns to its safe position upon each partial squeezing and release of the trigger, and which prevents and aborts efforts to maintain the safety lever in its fire position or to continuously bias the safety toward its fire position. More particularly, the present invention includes a safety lever movable between safe and fire positions, a safety latch, a trigger, a sear pivot pin pivotally carried by the trigger and carrying a sear, and a spring biased hammer which is cocked and released by the sear for firing the gun. The safety lever, safety latch, trigger, and sear pivot pin and provided with cam surfaces which: (a) return the safety latch to the safe position upon partial movement thereof toward the fire position whereby the safety lever must be thrust into the fire position to set and enable the trigger to fire the gun; (b) return the safety latch to the safe position upon partial squeezing and release of the trigger without firing the gun; (c) more the safety latch and safety lever to the safe position upon each firing of the gun whereby the safety lever must be moved to the fire position before the gun can be fired again; (d) render the trigger in operable in response to application of a continuous force biasing the safety lever toward the fire position; and (e) lock the trigger in an inoperative position when the safety lever is jammed into and maintained in the fire position in an effort to continuously maintain the safety lever in the fire position. These functions are accomplished by this minimum number of discrete parts and which parts are repeatedly reliable to achieve such functions.

Accordingly, it is a primary object of the present invention to provide a novel and improved safety for the trigger mechanism of a gun.

It is another object of the present invention to provide a novel and improved safety for the trigger mechanism of a gun in which the safety lever must be moved full distance between its safe and fire positions before the trigger is enabled and the safety mechanism automatically returns to the safe position upon only partial movement of the safety lever toward the fire position.

It is still another object of the present invention to provide a novel and improved safety for the trigger mechanism of a gun wherein the safety latch is automatically returned to its safe position upon partial squeezing and release of the trigger.

It is still another object of the present invention to provide a novel and improved safety for the trigger mechanism of a gun wherein the safety latch and safety lever are returned to its safe position automatically upon each firing of the gun thereby requiring movement of the safety lever to its fire position before the gun can be fired again.

It is a further object of the present invention to provide a novel and improved safety for the trigger mechanism of a gun which maintains the gun in a single shot firing mode and prevents automatic or fast repeat firing of the gun.

Another object of the invention is to provide a safety mechanism which avoids firing gas freeze-up occurring as a result of rapid repeat firing of the gun.

It is still a further object of the present invention to provide a novel and improved safety for the trigger mechanism of a gun which thwarts efforts to bypass use of the safety.

It is a still further object of the present invention to provide a novel and improved safety for the trigger mechanism of a gun for preventing the trigger mechanism from firing the gun in the event a continuous bias is applied to the safety lever tending to move it toward its fire position.

It is a still further object of the present invention to provide a novel and improved safety for the trigger mechanism of a gun wherein the trigger mechanism is rendered inoperative in the event the safety lever is jammed and maintained in its fire position.

It is a related object of the present invention to provide a novel and improved safety for the trigger mechanism of a gas fired gun having the foregoing characteristics; wherein a small number of elements are provided to achieve such characteristics, and which elements perform repeatedly and reliably.

These and further objects and advantages of the present invention will become more apparent upon reference to the following specification, appended claims and drawings wherein:

Figure 1:
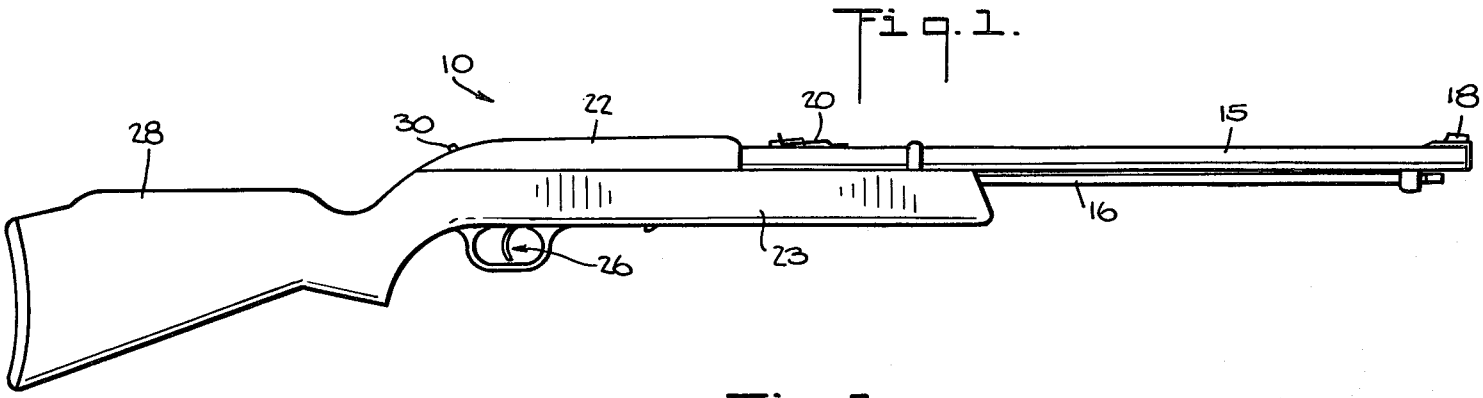
FIG. 1 is a side elevational view of a gun containing a trigger mechanism and a safety constructed in accordance with the present invention.
Figure 2:
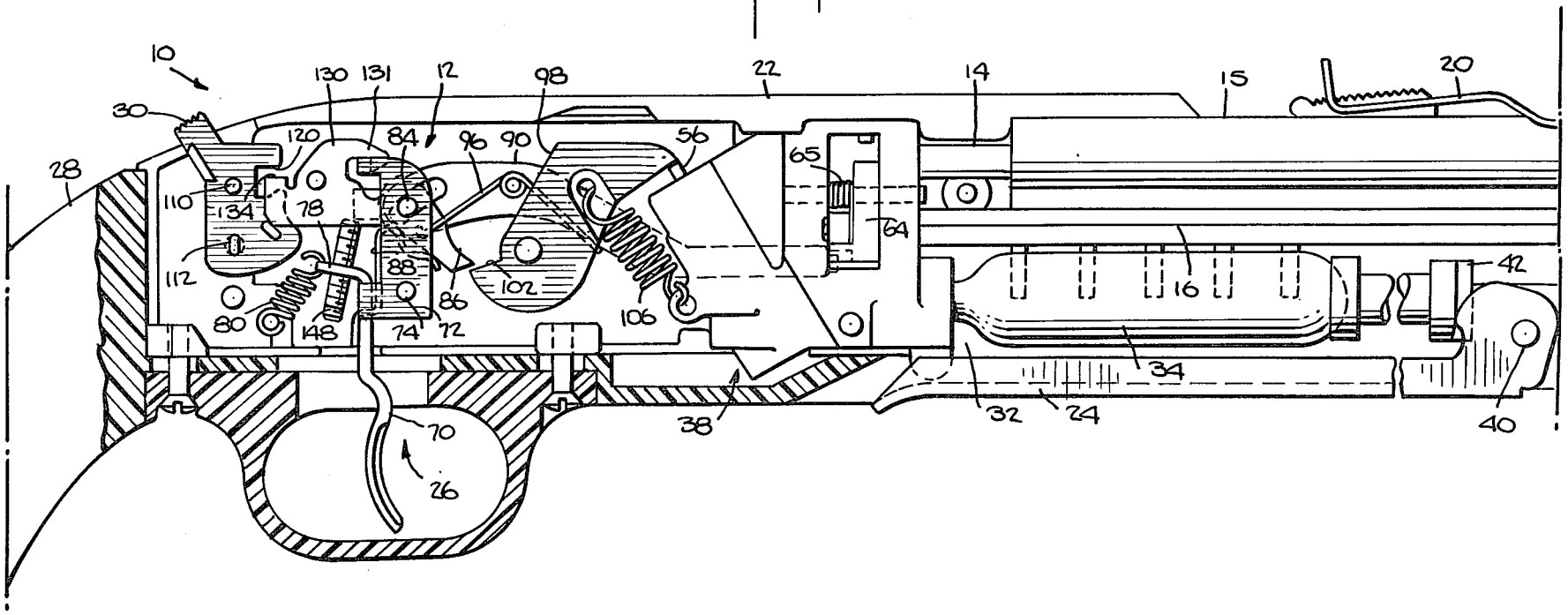
FIG. 2 is an enlarged longitudinal cross-sectional view illustrating the trigger mechanism and safety with the safety lever in the safe position.

Referring now to the drawings, particularly to FIGS. 1 and 2, there is illustrated a gun, particularly a gun generally designated 10, containing a safety and trigger mechanism, generally designated 12, constructed in accordance with the present invention. Gun 10 includes a barrel 14 within a barrel shroud 15, a magazine tube 16 underlying barrel 14 and barrel shroud 15 for housing individual BB shot, a front sight 18 and a rear sight 20 both mounted on barrel shroud 15, a receiver or frame 22, a stock 23, a cam lever 24, a trigger 26, a stock 28, and a safety lever or element 30. It will be appreciated that, except for the safety and trigger as discussed in detail hereinafter, the foregoing elements as well as their arrangement and function, are generally well known in this art and further description thereof is not believed necessary.

The receiver 22 within stock 23 carries a chamber 32 for receiving a cartridge 34 containing a gas under pressure. An end of cartridge 34, when in chamber 32, is received in a puncturing or piercing device 36 for puncturing cartridge 34 to admit gas into a valve assembly, generally designated 38. Cam lever 24 is pivotally carried by receiver 22 on a pin 40 and cams against a block 42 carried by a spring biased cam rod 44. When cam lever 24 is pivoted about pin 40 outwardly away from receiver 22, a spring, not shown, displaces cam rod 44 and cam block 42 forwardly enabling insertion of gas cartridge 34 into chamber 32. When cam lever 24 is pivoted about pin 40 toward receiver 22, it urges the cam block 42 against the cartridge and against the bias of the spring, not shown, such that the opposite end of the cartridge is punctured by the puncture device 36.

Figure 5:
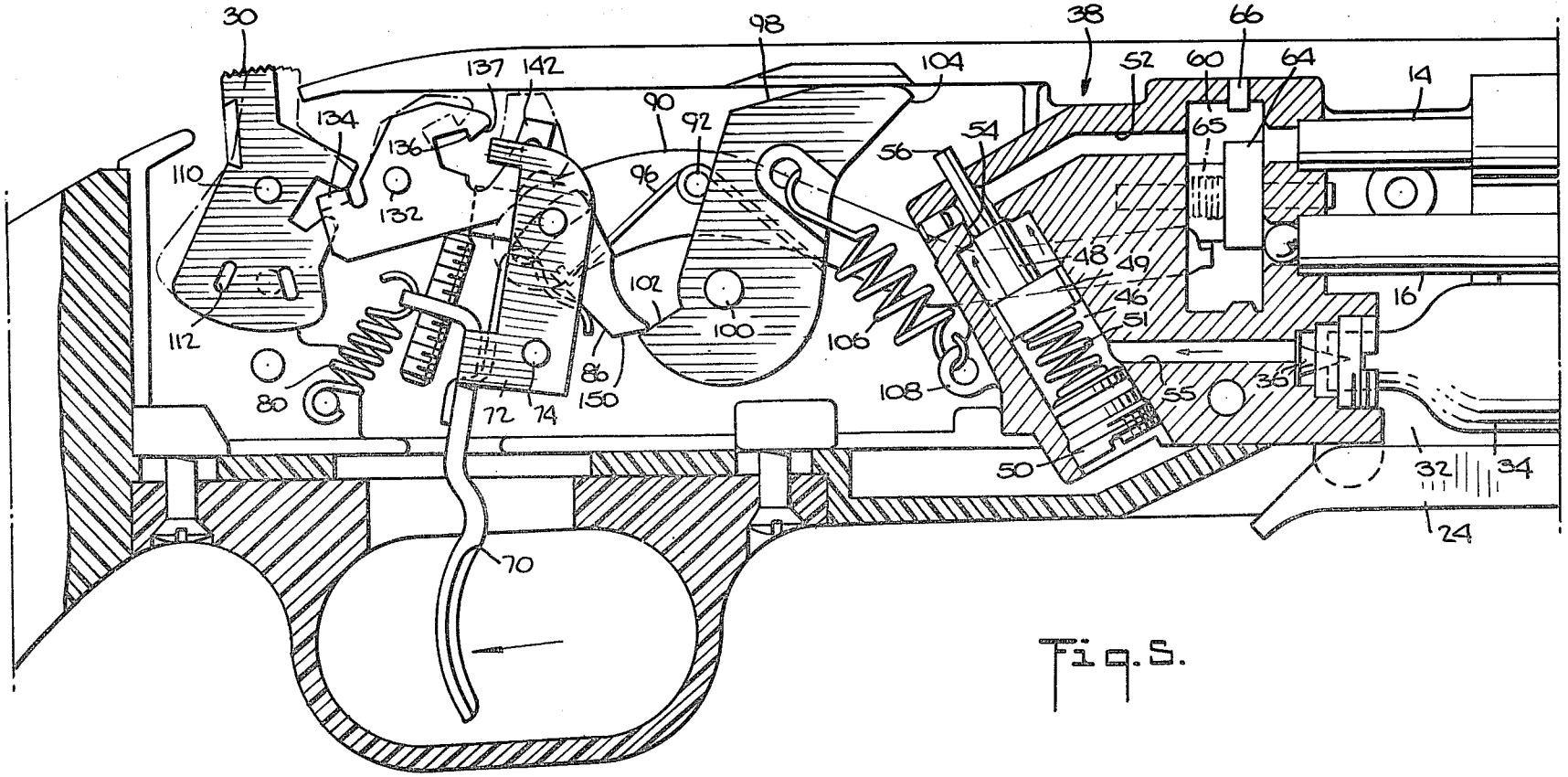
FIG. 5 is an enlarged longitudinal cross-sectional view illustrating the positions of the various parts of the safety and trigger mechanism when the trigger is partially squeezed and also illustrating the valve assembly for the gas fired gun.

Referring to FIG. 5, valve assembly 38 includes a valve chamber 46 carrying a valve stem 48 separated from a plug body 50 by a spring 51. The upper end of valve stem 48 seals against the valve body about an inlet port 54 to a passageway 52. Valve stem 48 has a base 49 which is polygonal in cross-sectional shape enabling gas from cartridge 34 to pass through passageway 55 into chamber 46 and beyond polygonal base 49 into a passageway 52 when valve stem 48 is depressed against the bias of spring 51 breaking the seal at port 54. As illustrated in FIG. 5, the valve stem includes a pin 56 which projects outwardly of the valve body wherein valve stem 48 can be depressed.

A chamber 60 is also provided in valve body 38 for housing a projectile or BB shot transfer mechanism, generally designated 62. Transfer mechanism 62 transfers a projectile or BB shot from tubular magazine 16 into a firing position in alignment with barrel 14 in response to a retraction or squeezing of the trigger 26. Particularly, the transfer mechanism includes a loader arm 64 having a passage 63 (FIG. 7) in registry with the end of magazine tube 16 for receiving the rearmost BB shot in magazine tube 16. The loader arm 64 is biased into such alignment by spring 65 and pivots, in response to actuation of the trigger, against the bias of spring 65 into a position aligning passage 63 with the BB shot in a firing position in registry with barrel 14 and passageway 52. A magnet 66 is carried by valve body 38 and maintains the BB shot in the firing position preventing it from rolling along barrel 14.

It will thus be appreciated that gun 10 is fired by momentarily depressing valve stem 48 to expel a charge of gas under pressure supplied from chamber 46 through passageway 52 to drive the BB shot in registry with the barrel 14 through the barrel. The loader or transfer mechanism 62 forms no part of the present invention and it is therefore believed that the foregoing description is adequate to describe the nature of such parts and to demonstrate operation of this aspect of the air gun. The transfer and valve mechanism may be of any suitable conventional type for example as shown in U.S. Pat. Nos. 3,119,384 or 3,261,134.

Figure 3:
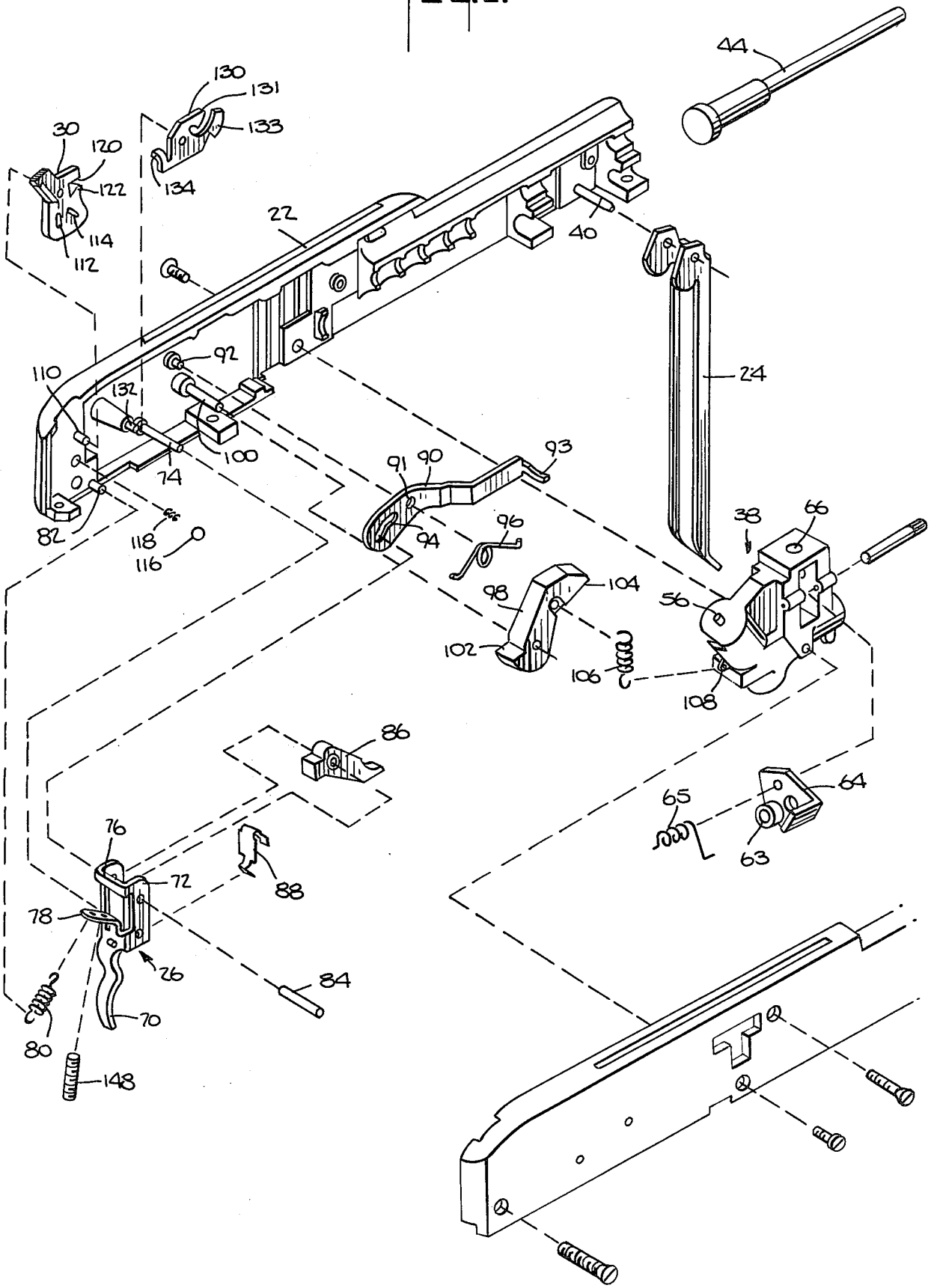
FIG. 3 is an exploded perspective view of the trigger mechanism and safety illustrating the various parts thereof.

Referring now particularly to FIGS. 2 and 3, trigger assembly 26 includes a trigger 70 having a generally U or channel shaped forwardly opening trigger arm or element 72 pivotally carried by receiver 22 about a pin 74. The opposed side walls of the upper end of element 72 are joined by a bar 76 and a tab 78 projects rearwardly from trigger 70. A trigger return spring 80 connects between tab 78 and a post 82 carried by frame 22 whereby trigger 70 is biased for pivotal movement about trigger pivot pin 74 in a generally counterclockwise direction as illustrated in FIG. 2.

Disposed between the opposed side walls of element 72 and mounted on a sear pivot pin 84 journalled in the side walls of element 72 is a sear 86. A sear spring 88 carried by trigger 70 engages the underside of sear 86 and biases it for pivotal movement in a counterclockwise direction as illustrated in FIG. 2.

A loader lever 90 is pivotally carried on frame 22 on a post 92, the lever 90 having a vertically enlarged opening 91 receiving post 92 for reasons discussed hereinafter. The loader lever 90 includes a kidney shaped opening 94 at its rear end which receives the sear pivot pin 84. The forward end of loader lever 90 has a laterally extending hook 93 (FIG. 3) which engages the loader arm 64 for the purpose of rotating the loader in response to squeezing trigger 70. A loader lever spring 96 is also carried on post 92.

A hammer 98 is pivotally carried on a post 100 in receiver 22. Hammer 98 carries a flat 102 at its rearmost end and a face 104 at its forward end and which face normally lies in engagement with valve pin 56. A hammer spring 106 interconnects hammer 98 with an ear 108 carried by valve body 38 for biasing the hammer 98 for pivotal movement in a clockwise direction as illustrated in FIG. 2.

Safety lever 30 is pivotally carried by receiver 22 about a pin 110 and has a pair of spaced detent openings 112 and 114. A safety detent ball 116 having a safety detent spring 118 (FIG. 3) for biasing ball 116 laterally inwardly from receiver 22 to engage safety lever 30 in one or the other of detent openings 112 and 114 is provided. Spring biased safety detent ball 116 also provides a drag on safety lever 30 during movement between its safe and fire positions. The forward edge of safety lever 30 is indented to form a pair of upper and lower cam surfaces 120 and 122 respectively.

Figure 4:
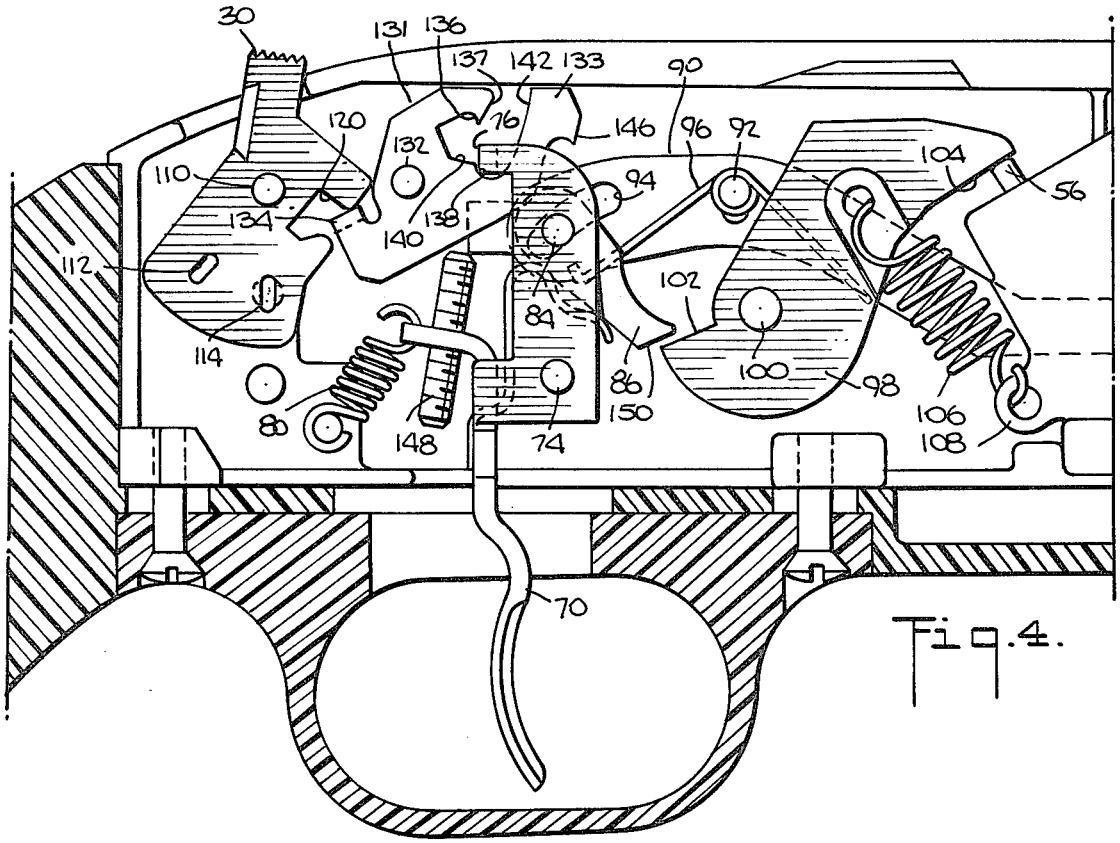
FIG. 4 is an enlarged longitudinal cross-sectional view of the trigger mechanism and safety illustrating the safety lever in the fire position.
Figure 6:
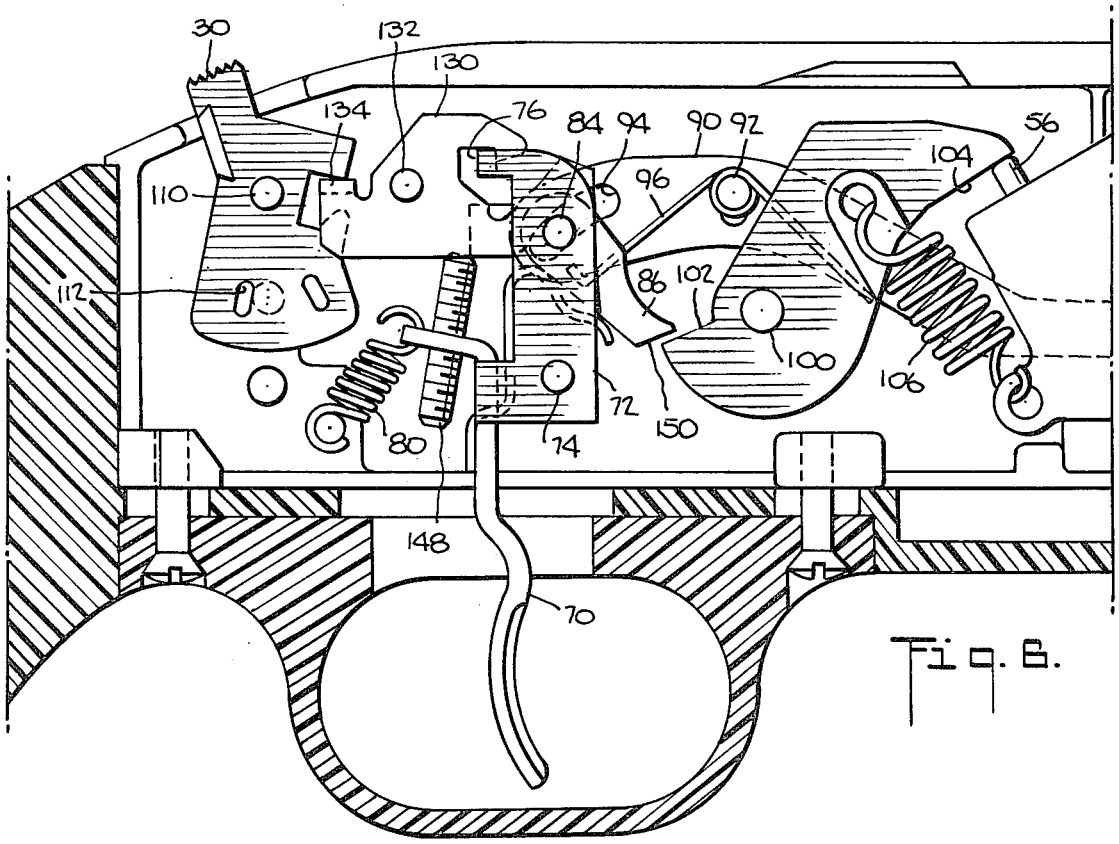
FIG. 6 is a view similar to FIG. 4 with the trigger partially squeezed and released.

Located between safety lever 30 and trigger element 72 is a safety latch 130 pivotally carried by frame 22 on a post 132. The rearmost end of safety latch 130 includes a tab or laterally bent flange 134 which extends between upper and lower cam surfaces 120 and 122 on safety lever 30. The forward end of safety latch 130 is also slotted defining upper and lower legs 131 and 133 respectively and carries a catch 136 on the upper leg 131. A cam surface 137 is provided along upper leg 131 forwardly of catch 136. Along the lower leg 133, there is provided a ledge 138 and spaced cam surfaces 140 and 142 (FIG. 4). An additional cam surface 146 is provided on the forward tip of the lower leg 133 of safety latch 130 for reasons discussed hereinafter.

When these parts are installed within frame 22, sear 86 extends between the opposite walls of element 72. A trigger set screw 148 is threaded through tab 78 and bears against the underside of sear 86 to provide a stop limiting the rotation of sear 86 in a counterclockwise direction as illustrated in FIG. 2 and also to angularly adjust the sear. Safety latch 136 is laterally offset from safety lever 30 and tab 134 extends between the upper and lower cam surfaces 120 and 122 respectively of safety lever 30. The lower leg 133 of safety latch 130 extends between the opposed side walls of element 72 and trigger bar 76 extends within the slot between the upper and lower legs 131 and 133 respectively of safety latch 130. Sear 86 carries a forward sear face 150 which is opposed to and is normally spaced from flat 102 on hammer 98. Hammer 98 rests on valve pin 56, the hammer spring 106 being fully relaxed or of insufficient strength to depress valve pin 56 against the bias of valve spring 51 with gas pressure in the valve. It will be observed that the height of valve stem 56 affects the timing of catch mechanism 130 in retaining trigger element 72.

In FIG. 2, the gun is illustrated at rest with safety lever 30 in a rearmost safe position. Safety detent ball 116 is spring biased to engage safety lever 30 in opening 112 to prevent its free movement. With the safety lever thus positioned, a pulling action on trigger 70 pivots trigger bar 76 into engagement with the catch 136 on the safety latch 130. Thus, further clockwise pivotal movement of the trigger as illustrated in FIG. 2 is prevented and sear 86 remains spaced from hammer 98.

In order to fire the gun, safety lever 30 is pivoted forwardly into the position illustrated in FIG. 4. It will be appreciated that this pivoting action causes upper cam surface 120 to engage tab 134 on safety latch 130 and rotate the latter is a counterclockwise direction is illustrated in FIGS. 2 and 4. Counterclockwise rotation of safety latch 130 cams or pivots the trigger in a clockwise direction about pivot pin 74 by the following engagement of the trigger bar 76 along the moving cam surface 140 on safety latch 130. Thus, the trigger is slightly rotated or retracted by the movement of the safety lever 30 from the safe position to the fire position.

When safety lever 30 is advanced into the fire position illustrated in FIG. 4, trigger bar 76 drops in front of and engages ledge 138 on the safety latch 130 by action of trigger spring 80 to set trigger 26 thereby enabling the gun to be fired without the catch 136 on safety lever 130 interfering with further clockwise movement of the trigger. Also, as safety lever 130 is advanced to the fire position, the consequent clockwise movement of trigger 26 pivots loader lever 90 in a counterclockwise as seen in FIG. 4 as a result of the forward movement of sear pivot pin 84 carried by the trigger element 72 working in the kidney shaped slot 94 in a loader lever 90. Rotation of loader lever 90 raises hook 93 which starts rotation of loader arm 64. Also, in displacing the safety lever forwardly to the fire position, the sear flat 150 is moved closer to the flat 102 on hammer 98 but remains spaced therefrom.

A feature of the present invention resides in the camming action which moves the safety lever back toward the safe position in the event the safety lever is only partially advanced to the fire position. From a review of FIG. 4, it will be appreciated that release of safety lever 30 before it obtains the fire position enables trigger bar 76 to cam along surface 140 and rotate safety catch 130 in a clockwise direction. Through the interaction of the flange 134 and the upper cam surface 120 on the latch and lever respectively and in response to this clockwise movement of safety latch 130, safety lever 30 rotates counterclockwise back towards its safe position. Once the safety lever is fully advanced, however, into the fire position as illustrated in FIG. 4, the spring detent ball 116 engages the safety lever 30 in the second detent opening 114 and the trigger bar is in engagement with the safety latch ledge 138. In this position the ledge 138 prevents return of the safety mechanism to the safe position and the gun is now set and ready to fire.

Figure 7:
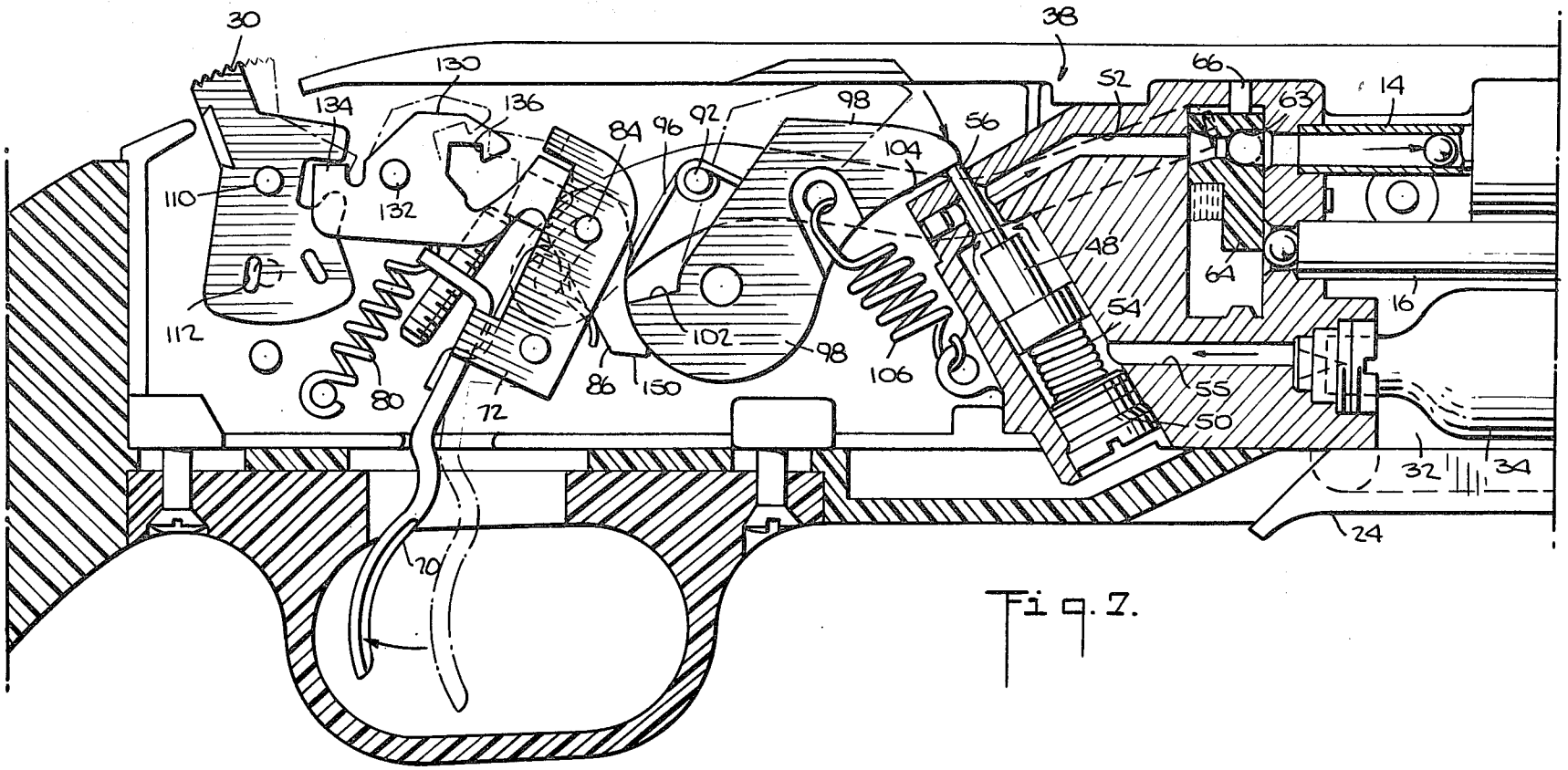
FIG. 7 is a view similar to FIG. 5 illustrating the various parts in positions with the trigger fully squeezed and the gun in firing position.

As the trigger is squeezed to fire the gun, the trigger rotates in a clockwise direction as illustrated in FIG. 5. This rotation causes the sear face 150 to engage the flat 102 on hammer 98. Also, movement of the trigger bar 76 in a forward direction cams safety latch 130 along cam surface 142 for clockwise rotation about pin 132 from the dashed line to the full line position as illustrated in FIG. 5. Clockwise rotation of safety lever 30 out of its detented fire position toward its safe position due to the interaction of flange 134 and upper cam surface 120. Continued clockwise rotational movement of the trigger also rotates loader lever 90 enabling further rotation of the loader 64. Continued rotation or squeezing of the trigger in a clockwise direction also causes sear 86 to rotate hammer 98 in a counterclockwise direction as illustrated in FIG. 7. Continued clockwise movement of the trigger and counterclockwise movement of safety latch 130 continue to rotate safety lever 30 toward its safe position. At this point, loader 64 is fully rotated by loader lever 90 to locate a BB shot from the magazine tube 16 to an in-line position with barrel 14. To prevent a bind while the hammer 98 continues to move back towards its release position, the action of the loader lever spring 96 enables the linkage to continue movement while the loader 64 remains stationary. That is, the loader lever 90 is slightly rotated in a counterclockwise direction with hook 93 serving as a pivot. The elongated slot 91 in lever 90 enables such rotation without binding on pin 92 and this, together with loader lever spring 96 enables give in the linkage while simultaneously spring 96 holds loader 64 in its gun loaded position.

Further movement of the trigger in a clockwise direction as illustrated in FIG. 7 enables sear 86 to fall off flat 102 on hammer 98 enabling hammer spring 106 to rapidly rotate hammer 98 in a clockwise direction and engage and depress valve pin 56. As noted previously, momentary depression of the valve stem enables the gas from the cartridge to flow through the valve assembly and drive the BB shot from the loader arm 64 and into and through the barrel. Substantially simultaneously, the safety lever is fully returned to its safe position.

Thus when the gun has been fired, safety lever 30 is returned fully to its safe position. Upon return of trigger 70 under the bias of trigger spring 80 and loader spring 65, sear pivot pin 84 engages the cam surface 146 on the front side of the lower leg 133 of safety latch 130 to pivot safety latch 130 in a generally counterclockwise direction. This enables trigger bar 76 to enter the slot between the upper and lower legs 131 and 133 respectively, of safety latch 130 without initially engaging the legs 131 and 133. This counterclockwise movement continues until trigger bar 76 engages the cam surface 137 on the forward edge of catch 136 of safety latch 130 whereupon it continues to pivot safety latch 130 in a counterclockwise direction. This continued counterclockwise movement moves cam surface 146 off or away from its engagement with sear pivot pin 84. Initial camming of the sear pivot pin against the safety latch is necessary to enable sufficient clockiwse movement of safety latch 130 to permit entry of the trigger bar into the slot between legs 131 and 133. Continued movement of the safety latch 130 is then accomplished by the trigger bar 76 camming on the safety latch surface 137 to permit sufficient clearance between safety latch 130 and the sear pivot pin for subsequent latching of bar 76 into catch 136. Note that during most of the return of the trigger, the safety latch flange 134 is free to rotate between safety lever cam surfaces 120 and 122 without moving the safety lever. However, just before bar 76 on the trigger advances from safety lever cam surface 137 to catch 136, flange 134 contacts surface 122 on the safety lever and causes the safety lever to rotate clockwise against the spring loaded detent ball 116 at detent opening 112. There is sufficient freedom of movement of this detent system to permit the safety lever to move toward the fire position momentarily and back without the detent ball 116 leaving detent opening 112. When the bar 76 is in the catch 136, the spring loaded ball detent prevents safety latch rotation out of the catch position under the effect of gravity when the gun is inverted. Thus the gun will not fire when upside down. Trigger return spring 80 and loader spring 65 in combination are normally strong enough to momentarily displace the safety lever against the resisting effect of the detent ball, however sear surface 150 will not engage hammer flat 102 until the catch condition is achieved and the gun is therefore in the "safe" condition if the return springs 80 and 65 do not return the trigger fully.

Normally, continued counterclockwise return of the trigger displaces sear 86 along the arcuate lower surface of hammer 98 to a position where sear 86 clears the hammer flat 102 and returns to its original position as shown in FIG. 2 under the bias of sear spring 88. Thus, sear 86 returns to a position in which it may once again cock the hammer and the loader arm 64 fully returns to a position to accept another BB shot from the magazine. Full return of the trigger to its forwardmost position locates the trigger bar within the slot of the safety latch and along its cam surface 140. Consequently, upon firing, safety lever 30 is fully returned to its safe position and movement into the fire position is required before the gun can be fired again.

Should the trigger be only partially squeezed and released before firing the gun, the safety lever is automatically moved toward its safe position and the gun is disabled from firing again until the safety lever is moved once again into the fire position. It will be recalled that upon squeezing the trigger with the safety lever in the fire position, trigger bar 76 cams along surface 142 of safety latch 130 to rotate it in a clockwise direction and safety lever 30 in a counterclockwise direction through the interaction of flange 134 and upper cam surface 120 as illustrated in FIG. 5. Once trigger 26 is squeezed and trigger bar 76 has caused sufficient clockwise rotation of safety latch 130 such that release and return of the trigger under the bias of spring 80 enables trigger bar 76 to engage cam surface 140 rather than ledge 138, further return of the trigger causes trigger bar 76 to rehook cam surface 136 resulting in further clockwise rotation of safety latch 130. This, in turn, causes return of the safety lever 30 toward its safe position through the interaction of flange 134 and cam surface 120. If the trigger is squeezed to a greater extent and then released, the trigger bar 76 will engage cam surface 137 on catch 136 upon return of the trigger under its spring bias. This causes an initial counterclockwise rotation of safety latch 130. This does not, however, rotate the safety lever due to the substantial spacing between cam surfaces 120 and 122. Thereafter, clockwise rotation of safety latch 130 obtains when trigger bar 76 engages cam surface 140 with consequent return of the safety lever to its safe position. Thus, partial squeezing and release of the trigger returns the safety lever toward its safe position desirably necessitating manual movement of the safety lever into the fire position before the gun can be fired.

Figure 8:
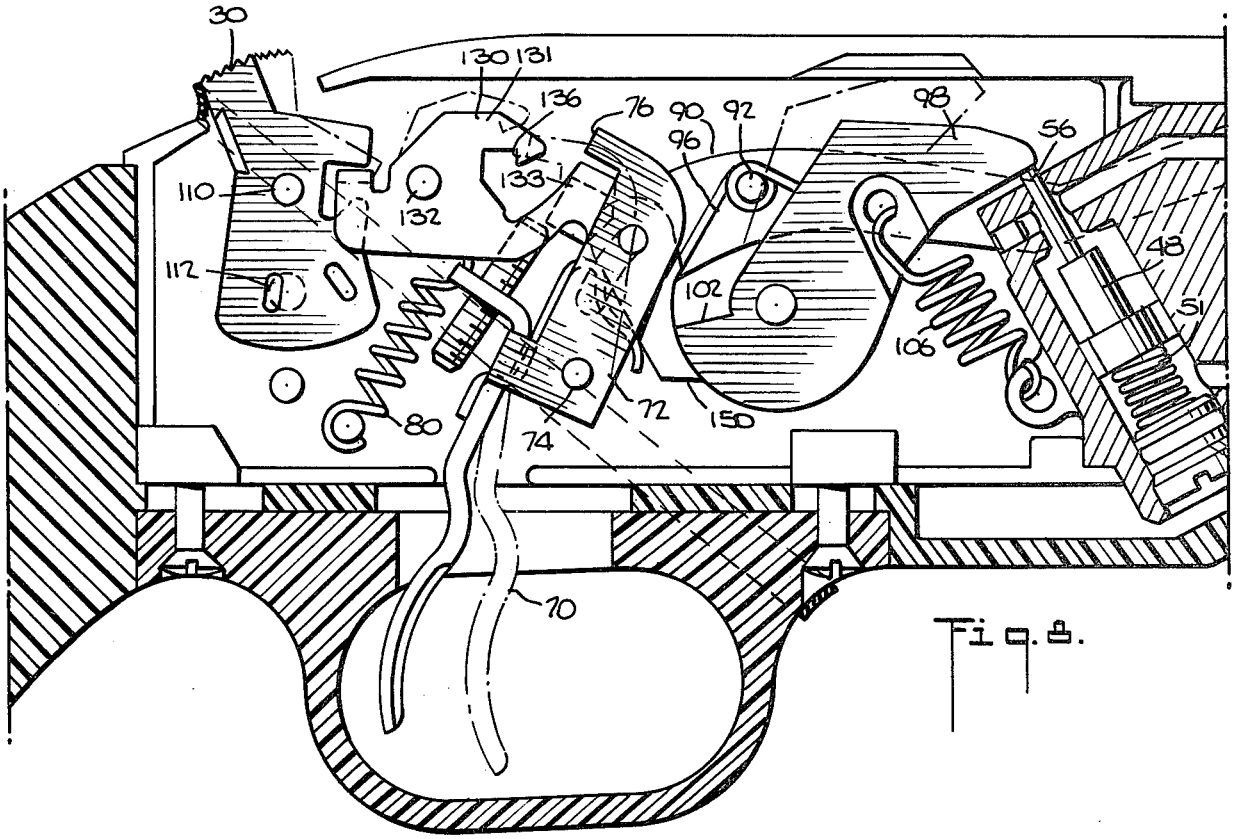
FIGS. 8 and 9 are views similar to FIGS. 4 and 6 illustrating operation of the safety and trigger mechanism with a continuous forward bias applied to the safety lever tending to move it toward the fire position.
Figure 9:
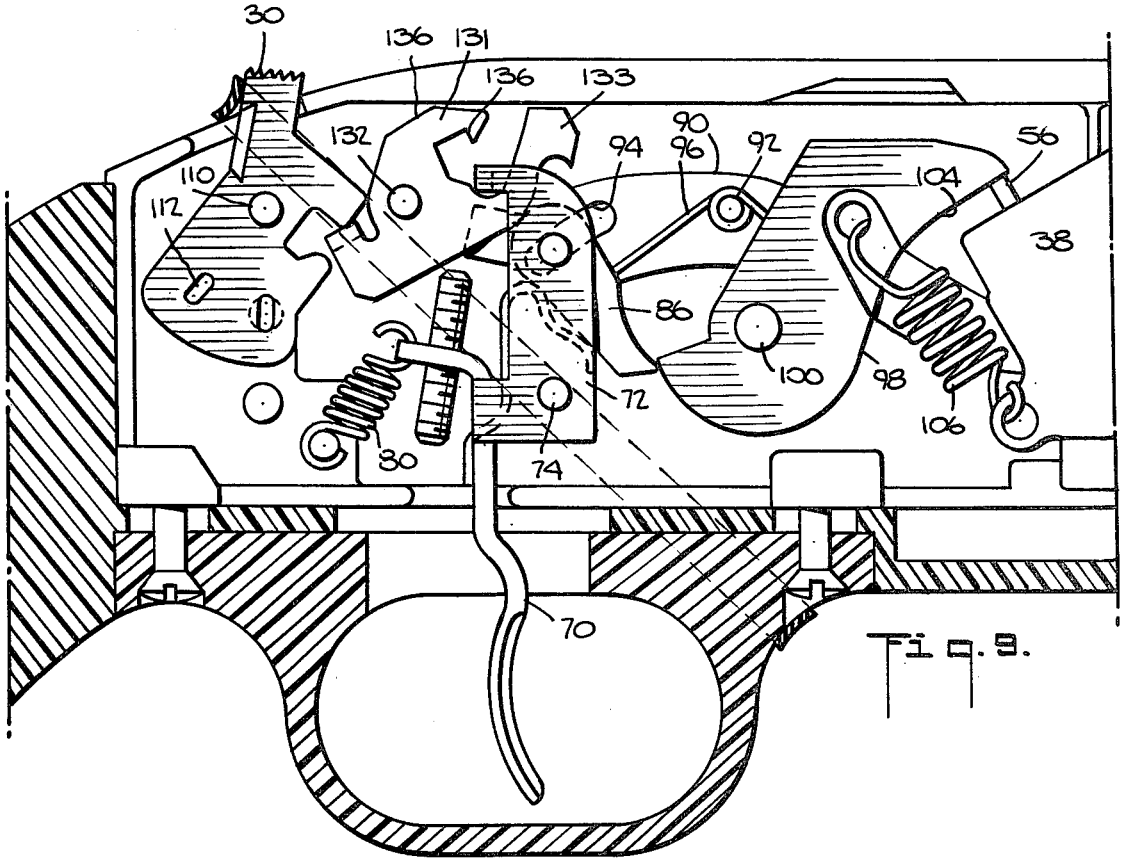

As sometimes occurs, individuals may tamper with the gun in an effort to avoid moving the safety from the safe position to the fire position for each shot fired. That is, individuals may attempt to bypass operation of the safety and continuously bias the safety lever into the fire position, for example by means of a rubber band as illustrated in FIGS. 8 and 9. The present safety and trigger mechanism of the present invention, however, prevents the gun from firing under these circumstances after the initial shot is fired. To this end, and referring particularly to FIGS. 8 and 9, there is illustrated a rubber band B disposed about the stock against the trigger guard and bearing on the safety lever whereby the lever is biased toward its fire position. When the rubber band is initially placed about the gun and the safety moved to the fire position, the safety and trigger mechanism assume the position illustrated in FIG. 4. In this position the trigger may be squeezed to cock the hammer and the gun may be fired similarly as previously described. Upon squeezing the trigger, the safety lever is moved back to its safe position against the bias of the rubber band. When the sear falls off the flat on the hammer, the gun will fire as described previously and the only effect up to this point that the rubber band has is to increase the trigger forces.

Once the gun has fired, however, the trigger bar 76 returns along the same patch on the safety latch as it did upon pulling the trigger. This is different from normal operation where the return path is determined by other cam surfaces. Thus, the forward bias on the safety lever afforded by rubber band B after firing causes the safety lever to rotate in a clockwise direction as illustrated in comparing FIG. 7 and FIG. 9. Upon such rotation, the upper cam surface 120 on safety lever 30 engages flange 134 and rotates safety latch 130 in a counterclockwise direction to the position illustrated in FIG. 9. Trigger bar 76 moves along the upper cam surface 142 on the lower leg 133 of safety latch 130. Continued counterclockwise rotation of the safety latch 130 as illustrated in FIG. 9 bottoms trigger bar 76 against ledge 138 preventing further and complete return or pivotal movement of the trigger. At this point, however, sear 86 still bears against the lower side of hammeer 98 and cannot return to a position above flat 102 to cock the hammer. Thus, if the trigger is again pulled, the sear will only slide along the underside of hammer 98 and is prevented from cocking hammer 98. Consequently, repeat firing of the gun with the safety lever continuously biased toward the fire position is prevented.

To return the gun to its normal operation, the safety must first be moved to the safe position and then secondly to its fire position.

Jamming the safety lever in its fire position, for example by inserting a rigid object inyto the slot behind the safety lever when it lies in its fire position, in an effort to avoid or bypass the safety serves only to lock the trigger assembly preventing firing of even a single shot. That is, by moving the safety into its first position, the safety latch is moved to the position illustrated in FIG. 9. Upon squeezing the trigger, it will be recalled that the safety lever under normal firing conditions rotates back toward its safe position. However, by holding the safety lever forwardly in its fire position, safety latch 130 is held in its extreme rotated position illustrated in FIG. 9 by the interaction of cam surface 120 of safety lever 30 and flange 134. Thus trigger bar 76 engages and jams against the cam surface 142 of safety latch 130. Further squeezing of trigger 26 is thereby prevented and the gun cannot fire. To fire the gun, the jam, i.e. the rigid object disposed into the slot behind the safety lever, must first be removed to enable the safety lever to return to its safe position. Thereafter, the safety lever must again be advanced into its fire position.

In operation of guns of this type, sticks, twigs, dirt, etc., are sometimes loaded inadvertently with BB's into the gun. This debris may interfere with loader rotation to prevent BB transfer from the magazine to the firing position, or to prevent return of the loader magazine position. The trigger mechanism provides positive forward and reverse movement of the BB loader, so that the loader jam may be removed by manipulating the trigger back and forth through its normal range of movement. It will be understood in this regard that, in normal operation, loader spring 65 and trigger return spring 80 cooperate to return both trigger mechanism and loader to their normal positions. Should either spring fail, the other is adequate under normal conditions to return the trigger mechanism.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. A safety for the trigger mechanism of a gun comprising:

a gun frame;

a trigger carried by said frame for movement between first and second positions;

means carried by said frame for firing the gun in response to movement of said trigger into said second position;

a safety element carried by said frame for movement between safe and fire positions;

means coupled to said safety element for preventing movement of said trigger into said second position when said safety element lies in said safe position and enabling movement of said trigger into said second position when said safety element lies in said fire position; and means coupled to said safety element for returning said safety element to its safe position in response to movement of said trigger between its first position and its second position.

2. A safety according to claim 1 wherein said return means moves said safety element toward its safe position in response to movement of said trigger from said first position toward its second position.

3. A safety according to claim 2 including means carried by said frame for biasing said trigger for movement toward said first position, said return means being adapted to move said safety element towards its safe position in response to partial movement of said trigger from said first position toward its second position and release thereof.

4. A safety according to claim 1 wherein said prevent means includes a safety latch carried by said frame for movement between first and second positions, said safety latch in said first position having a catch engageable with said trigger to prevent movement of said trigger into its second position, said safety latch in said second position locating said catch out of the path of movement of said trigger when said trigger is moved toward its second position.

5. A safety according to claim 4 including means cooperable between said safety element and said safety latch for moving said safety latch into its second position in response to movement of said safety element into said fire position.

6. A safety according to claim 5 including means cooperable between said safety latch and said trigger for moving said trigger from its first position towards its second position in response to movement of said safety latch toward its second position.

7. A safety according to claim 4 including means cooperable between said safety latch and said trigger for moving said trigger from its first position towards its second position in response to movement of said safety latch toward its second position.

8. A safety according to claim 4 including means cooperable between said safety element and said safety latch for moving said safety element towards said safe position in response to movement of said safety latch toward its first position.

9. A safety according to claim 8 including means cooperable between said safety latch and said trigger for moving said safety latch toward its first position in response to movement of said trigger toward its second position.

10. A safety according to claim 4 including means cooperable between said safety latch and said trigger for moving said safety latch toward its first position in response to movement of said trigger toward its second position.

11. A safety according to claim 4 including means cooperable between said safety latch and said trigger for moving said trigger from its first position towards its second position in response to movement of said safety latch toward its second position, and means cooperable between said safety latch and said trigger for moving said safety latch toward its first position in response to movement of said trigger toward its second position.

12. A safety according to claim 4 including means cooperable between said safety element and said safety latch for moving said safety latch into its second position in response to movement of said safety element into said fire position, means cooperable between said safety element and said safety latch for moving said safety element towards said safe position in response to movement of said safety latch toward its first position.

13. A safety according to claim 4 including means cooperable between said safety element and said safety latch for moving said safety latch into its second position in response to movement of said safety element into said fire position, means cooperable between said safety latch and said trigger for moving said safety latch toward its first position in response to movement of said trigger toward its second position.

14. A safety according to claim 4 including means cooperable between said safety latch and said trigger for moving said trigger from its first position towards its second position in response to movement of said safety latch toward its second position, means cooperable between said safety element and said safety latch for moving said safety element towards said safe position in response to movement of said safety latch toward its first position.

15. A safety according to claim 4 including means cooperable between said safety latch and said trigger for moving said trigger from its first position towards its second position in response to movement of said safety latch toward its second position, means cooperable between said safety element and said safety latch for moving said safety element towards said safe position in response to movement of said safety latch toward its first position.

16. A safety according to claim 4 including means cooperable between said safety latch and said trigger for moving said trigger from its first position towards its second position in response to movement of said safety latch toward its second position, means cooperable between said safety element and said safety latch for moving said safety element towards said safe position in response to movement of said safety latch toward its first position, means cooperable between said safety latch and said trigger for moving said safety latch toward its first position in response to movement of said trigger toward its second position.

17. A safety according to claim 16 including means cooperable between said safety element and said safety latch for moving said safety latch into its second position in response to movement of said safety element into said fire position.

18. A safety according to claim 4 including means for biasing said trigger for movement toward said first position, means cooperable between said safety latch and said trigger for moving said trigger from said first position toward said second position and against the bias of said biasing means in response to movement of said safety latch towards said second position, means cooperable between said safety latch and said trigger and between said safety element and said safety latch to releasably lock said safety latch in said second position.

19. A safety according to claim 4 wherein said trigger includes a bar engageable with said catch, said safety latch having a pair of legs for receiving the trigger bar therebetween, said catch being carried by one of said legs for engagement with said trigger bar when received between said legs, and means cooperable between said trigger bar and the other of said legs for moving said safety latch towards said first position in response to movement of said trigger toward said second position.

20. A safety according to claim 19 including means cooperable between said safety element and said safety latch for moving said safety element towards said safe position in response to movement of said safety latch toward its first position.

21. A safety according to claim 4 wherein said trigger includes a bar engageable with said catch, said safety latch having a pair of legs for receiving the trigger bar therebetween, said catch being carried by one of said legs for engagement with said trigger bar when received between said legs, and means cooperable between said trigger and the other of said legs for moving said safety latch into a position enabling entry of said trigger bar between said legs in response to movement of said trigger toward said first position.

22. A safety according to claim 21 including means cooperable between said trigger bar and said one leg for moving said safety latch into a position enabling entry of said trigger bar between said legs in response to movement of said trigger toward its first position.

23. A safety according to claim 4 wherein said trigger includes a bar engageable with said catch, said safety latch having a pair of legs for receiving the trigger bar therebetween, said catch being carried by one of said legs for engagement with said trigger bar when received between said legs, and means cooperable between said trigger bar and said one leg for moving said safety latch into a position enabling entry of said trigger bar between said legs in response to movement of said trigger toward said first position.

24. A safety according to claim 1 including a sear carried by said trigger, a hammer carried by said frame, a firing pin carried by said frame, means biasing said hammer for movement toward said firing pin, said sear being engageable with said hammer to move said hammer against the bias of said biasing means in response to movement of said trigger toward said second position and releasable from said hammer when said trigger lies in said second position to enable the biasing means to move said hammer against said firing pin.

25. A safety according to claim 24 wherein said prevent means includes a safety latch carried by said frame for movement between first and second positions, said safety latch in said first position having a catch engageable with said trigger to prevent movement of said trigger into its second position, said safety latch in said second position locating said catch out of the path of movement of said trigger when said trigger is moved toward its second position, said trigger including a bar engageable with said catch, said safety latch having a pair of legs for receiving said trigger bar therebetween, said catch being carried by one of said legs for engagement with said trigger bar when received between said legs, and a sear pin carried by said trigger for pivotally carrying said sear, said sear pin being engageable with the other of said legs to move said safety latch into a position enabling entry of said trigger bar between said legs in response to movement of said trigger toward its first position.

26. A safety according to claim 25 including means cooperable between said trigger bar and said one leg for moving said safety latch into a position enabling entry of said trigger bar between said legs in response to movement of said trigger toward its first position.

27. A safety according to claim 24 including means cooperable between said safety element and said safety latch for moving said safety latch into its second position in response to movement of said safety element into said fire position, means cooperable between said safety latch and said trigger for moving said trigger from its first position towards its second position in response to movement of said safety latch toward its second position.

* * * * *